United States Patent [19]

Caudill

[11] Patent Number: 4,809,716

[45] Date of Patent: Mar. 7, 1989

[54] TOBACCO LEAF CLEANING MACHINE

[76] Inventor: Charles R. Caudill, P.O. Box 729 - Space 1062, Apache Junction, Ariz. 85217

[21] Appl. No.: 176,204

[22] Filed: Mar. 31, 1988

[51] Int. Cl.[4] ..... A24B 5/08; A24B 5/16

[52] U.S. Cl. ..... 131/325; 131/300; 15/179; 15/159 A; 15/77

[58] Field of Search ..... 131/325, 300; 15/102, 15/179, 181, 159 A, 77

[56] References Cited

U.S. PATENT DOCUMENTS

| | | | |
|---|---|---|---|
| 973,228 | 10/1910 | Spierer . | |
| 1,831,953 | 11/1931 | Fonseca . | |
| 2,942,607 | 6/1960 | Skinner . | |
| 3,355,758 | 12/1967 | Clark | 15/181 |
| 3,755,847 | 9/1973 | Liebscher | 15/181 X |
| 3,839,763 | 10/1974 | Gould | 15/181 |
| 3,855,659 | 12/1974 | Grambor | 15/181 |

FOREIGN PATENT DOCUMENTS

| | | | |
|---|---|---|---|
| 0026683 | 12/1905 | United Kingdom | 131/325 |

*Primary Examiner*—V. Millin
*Assistant Examiner*—Joe H. Cheng
*Attorney, Agent, or Firm*—LaValle D. Ptak

[57] ABSTRACT

A tobacco leaf cleaning system for removing foreign particles such as lint and string from tobacco leaves comprises a succession of side-by-side rollers mounted for rotation in the same direction for transfering tobacco leaves supplied thereto from one roller to the next. The surfaces of the rollers have discontinuities on them and each roller is covered with a sheet consisting of a plurality of densely packed resilient hook members. These hook members may be made of the male portion of a Velcro fastener for engaging and retaining lint and foreign particles as tobacco leaves are transferred from one roller to the next. The sheet of resilient hook members is removably mounted on the surface of the roller for replacement when it becomes filled with lint and foreign matter.

21 Claims, 1 Drawing Sheet

TOBACCO LEAF CLEANING MACHINE

BACKGROUND

Before various articles can be made from tobacco leaves, it is necessary to clean the leaves to remove dust and other contaminants from them. Prior to processing, tobacco leaves are subjected to a wide variety of contamination from insects, dust, sand and the like. In addition, the leaves of flue-cured tobacco are tied together and looped onto tobacco sticks with cotton string which supports the leaves in the curing barns during the curing process. Frequently, these cotton strings or portions of the strings become mixed in with the leaves during the subsequent processing operations.

Tobacco scraps and some tobacco leaves also are packed in burlap sacks for delivery from the growers to the processing plants; and when tobacco scraps and leaves are emptied from such burlap bags, burlap fibers become mixed in with the leaves and scraps of tobacco. A variety of other foreign matter also frequently is present.

Because of the presence of foreign matter in the tobacco leaves and tobacco scraps, the tobacco in a typical processing plant is placed on tables and moved on conveyors past operators who manually pick out the largest and most obvious contaminants, such as string segments, feathers, straw and the like. It is difficult, however, if not impossible, for such operating personnel to remove fine particles such as burlap bag fibers and cotton string fibers and similar contaminants from the tobacco; so that these smaller contaminants are overlooked.

To remove contaminants such as dust, string fibers, insect eggs and the like from the tobacco, tobacco cleaning machines have been developed using rotating brushes for engaging the tobacco leaves as they move on a carrier beneath the brushes. Two such tobacco cleaning machines are disclosed in the Patents to Spierer U.S. Pat. No. 973,228 and Fonseca U.S. Pat. No. 1,831,953. The devices of these two patents are somewhat similar to one another. Each of them employs a carrier to move the tobacco leaves into contact with rotating brushes to engage the surfaces of the leaves to remove strings, dust, insects, larva, eggs and other surface impurities from the tobacco. In Fonseca, the carrier is in the form of a relatively large drum, having a perforated surface and subjected to a partial vacuum to hold the leaves on the drum surface. The drum is rotated beneath rotating cleaning brushes which operate with a type of scrubbing action to remove the contaminants from the leaf surface.

In the machine disclosed in the Spierer U.S. Pat. No. 973,228, the tobacco leaves are carried on an endless belt conveyor in the form of strings which retain the leaves. The leaves then are moved past cleaning brushes which rotate in a direction opposite to the direction of movement of the leaves for dislodging contaminants from the surfaces of the leaves.

A rotating brush machine for cleaning tobacco scrap to separate the tobacco scrap from dirt and larger contaminants is disclosed in the Patent to Skinner U.S. Pat. No. 2,942,607. The machine of the Skinner patent employs a plurality of rotating brushes for moving the tobacco from a hopper up a series of inclined planes to separate the desired tobacco scraps from different sizes of contaminants in various stages of operation. Strings, burlap scraps and the like are intended to be removed by engaging them in the brushes and winding them onto the rotating brushes.

It has been found, however, that even when rotating brush cleaning machines of the type described above are used to remove foreign matter from tobacco leaves, the cleaned tobacco still includes fine particles of lint, string and the like. These particles ultimately become incorporated into the products made from the tobacco. While cleaning machines of the type disclosed in the patents described above do operate to remove a fairly large amount of contaminants from the tobacco leaves, a significant amount of contaminants still remain on the leaves and intermingled with them up to and through the final processing steps.

Consequently, it is desirable to provide a device which can be used to more effectively remove particles of lint, burlap bag fibers, string and other contaminants from tobacco leaves prior to the final processing of such leaves into various products. It further is desirable for such a device to be efficient in operation and inexpensive to manufacture, install, and maintain.

SUMMARY OF THE INVENTION

It is an object of the invention to provide an improved tobacco cleaning device.

It is an additional object of this invention to provide an improved device for removing foreign particles from tobacco leaves.

It is another object of this invention to provide an automatic tobacco leaf cleaning device.

It is a further object of this invention to provide an efficient and effective tobacco leaf cleaning device incorporating replaceable cleaning elements of a type which require minimum effort and minimum down time of the machine to effect such replacement.

In accordance with a preferred embodiment of the invention, a tobacco leaf cleaning system for removing foreign particles such as lint and string from tobacco leaves includes a plurality of rollers mounted side-by-side for rotation beneath the tobacco leaves which are to be cleaned. The rollers are rotated in the same direction for transferring tobacco leaves dumped on top of the rollers from one roller to the next roller in succession. The surfaces of each of the rollers have a cleaning element attached to them for removing and retaining lint and foreign particles from leaves which are contacted by the cleaning elements. In a more specific embodiment, the cleaning elements are removably mounted on the surface of the rollers; so that when the cleaning elements become dirty, they are readily replaced with new cleaning elements.

DETAILED DESCRIPTION

Figures 1, 2, 3, 4:
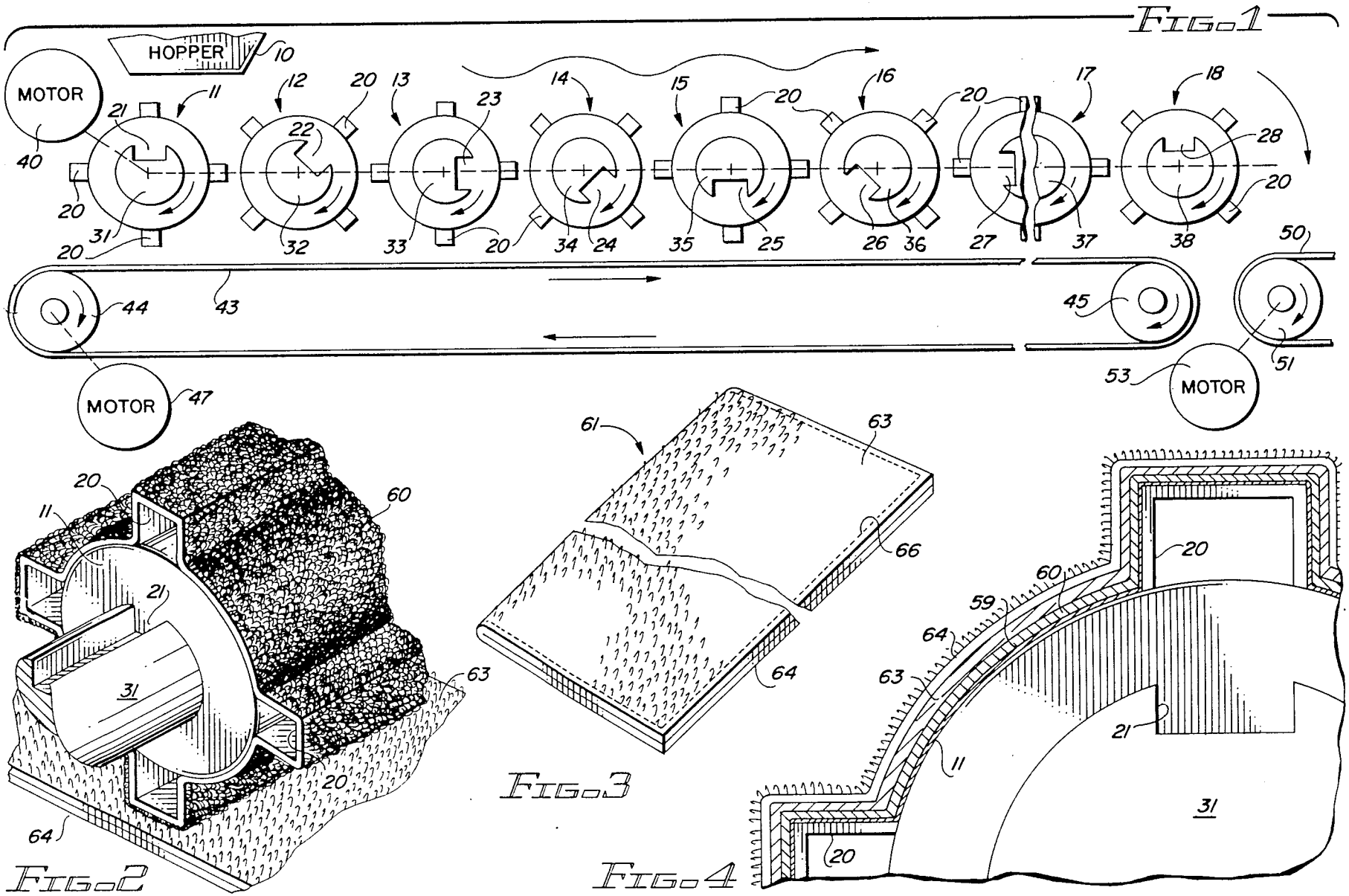
FIG. 1 is a diagramatic side view of a preferred embodiment of the invention.
FIG. 2 is a partially cut-away perspective view of one of the devices used in the embodiment of FIG. 1, illustrating constructional features of the device.
FIG. 3 is a perspective view of a cleaning element used in conjunction with the preferred embodiment of FIGS. 1 and 2.
FIG. 4 is a partial, enlarged cross-sectional view of the preferred embodiment of the invention, illustrating details thereof.

Reference now should be made to the drawing in which the same reference numbers are used throughout the different figures to designate the same components.

In the embodiment shown, tobacco leaves to be processed are dumped from the bottom of a hopper 10 (or conveyor) onto the left-hand one of a sucession of transversely mounted cleaning rollers 11 through 18. Each of the rollers 11 through 18 has four elongated rectangular protuberances 20 extending across the width thereof parallel to the roller axis. Each of the protuberances 20 are mounted at 90° intervals around the surface of the rollers 11 through 18. The rollers are secured for rotation by means of keys 21 through 28, respectively, onto motor driven shafts 31 through 38 for rotation with the shafts. A motor 40 is connected by means of any suitable interconnection mechanism to rotate all of the shafts 31 through 38 (and therefore the rollers 11 through 18) simultaneously in a clockwise direction.

The rollers 11 through 18 are closely spaced together; and to prevent the elongated protuberances 20 on one roller from striking or interfering with the protruberances on the next roller, each successive roller is secured by means of its key onto its respective shaft at an angle of 45° with respect to the preceeding roller and the next succeeding roller. This is readily apparent from an examination in FIG. 1.

Beneath all but the final roller 18 in the sequence shown in FIG. 1 is a conveyor belt 43, which is an endless belt conveyor. This conveyor belt is rotated on rollers 44 and 45 at each end and driven by a motor 47. Another conveyor belt 50 is located to the right of the end roller 18; and this endless belt conveyor rotates over a roller 51 driven by a motor 53. The operations of all three of the motors 40, 47 and 53 may be synchronized; and, in fact, a single motor drive with appropriate interconnections may be used to operate all of the rotating devices shown in FIG. 1. As tobacco leaves pass over the top of the final cleaning roller 18, they drop off in the direction of the arrow shown onto the conveyor 50 where they are moved to another position in the processing plant.

The construction of the cleaning rollers, 11 through 18, including the protuberances 20, is uniquely designed to produce a highly efficient removal of lint, burlap fibers, feathers and other contaminants from tobacco leaves which are bounced or transferred from one roller to the next in succession from left to right, as viewed in the apparatus of FIG. 1. The details of this construction are shown in FIGS. 2, 3 and 4.

In FIGS. 2 and 4, the roller 11 is shown, but it is to be understood that the structure of this roller is identical to that of all of the other rollers 12 through 18. Thus, the description concerning roller 11 which is given in conjunction with FIGS. 2 and 4 is applicable as well to all of the other identical rollers 12 through 18. FIG. 2, in particular, illustrates the manner in which the roller 11 is supported by and is secured for rotation on the shaft 31 by means of the key 21. The surface of the roller 11 and the 90° spaced protuberances 20 on its surface are covered with the loop or female portion 60 of a hook and loop fastener material, such as VELCRO® (a trademark of Velcro U.S.A., Inc.). This sheet of material 60 is permanently bonded to or attached to the surface of the roller 11 and the protuberances 20 by means of a suitable adhesive 59. Separate adhesive may be avoided if commercially available adhesive-backed VELCRO® is used. In either case, the material 60 is pressed into place to substantially conform to the configuration shown in FIG. 2.

The actual cleaning element for the rollers 11 through 18 then is comprised of the hook or male portion 61 of the hook and loop fastener material (such as VELCRO®) in the form of a folded-over sheet 61 having an inner surface 63 and an outer surface 64. The sheet 61 is stitched together along its edges by means of suitable stitching 66, and stitching also may be employed at intermediate points between the edges to secure the upper and lower sides 63 and 64 (as shown in FIG. 3) together.

The surfaces 63 and 64, constituting the hook portion of VELCRO fastener material, are in the form of a large number of closely packed, tiny, outwardly extending hook members. The hook members of the surface 63 then are pressed against and into a secure attaching relationship with the loop surface 60 on the surfaces of each of the rollers 11 through 18 along with the protuberances 20 on these rollers. Each of the sheets 61 has a width equal to the length of the rollers 11 through 18 and a length equal to the total distance around each of the rollers and the protuberances 20 on them; so that when the surface 63 is pressed into releasable engagement with the loop surface 60 bonded to each of the rollers, the sheets 61 are securely, but removably, held in place on the surfaces of the cleaning rollers. In FIG. 2, the surface 63 of the sheet 61 which is attached to the roller 11 is shown beneath the roller and the lower protuberance 20 prior to being wrapped around and pressed into engagement with the loop surface 60.

After the sheet 61 is pressed into place on the roller 11 (or 12 to 18), the structure which is shown in cross-section in FIG. 4 results. This causes the surface 64 of the folded-over sheet 61 to be exposed on the outer surface of the cleaning roller 11 and the attached protuberances 20. This allows the hook members of the surface 64 to contact tobacco leaves which are being moved and bounced from roller to roller in the direction of the wavey arrow in FIG. 1.

In place of a folded-over sheet 61, the surfaces 63 and 64 may be formed from elongated strips (preferably 1" wide) of back-to-back hook or male VELCRO® material applied side by side across the length of the rollers 11 to 18 and the protuberances 20. The end result is the same as when the sheet 61 is used.

As the tobacco leaves move over the top of the rollers 11 to 18, the hook members of the portions 64 engage lint and fibers and hold them firmly in place on the surfaces of the portions 64, thereby removing such lint, fibers and other contaminants from the leaves as the leaves move toward the right, as illustrated in FIG. 1. The protuberances 20 operate to bounce the leaves and to cause a type of scrubbing action against the leaves at a linear speed which is greater than the speed of the surfaces of the rollers 11 through 18 located between the protuberances, since the rotational velocity of all of the rollers is the same. This causes the orientation of the leaves to be changed and bounces them along to assist in shaking lint, string and other contaminants from the leaves. Such contaminants then are caught by and trapped in the hook members on the surface 64 of the cleaning element.

By locating the rollers in the physical orientation shown in FIG. 1, any leaf which tends to fall between adjacent rollers is pushed upwardly by the upward moving projection 20 on the next successive roller, so that very few, if any, leaves fall between the rollers in the succession of rollers 11 to 18 in the device shown in FIG. 1. Sand and other particle types of contaminants which are shaken from the leaves by the protuberances 20 on the cleaning rollers drop down onto the surface of the conveyor belt 43; and a suitable receptacle or the like may be used to receive such contaminants for subsequent disposal. As mentioned previously, the cleaned leaves passing over the final roller 18 are dropped onto the conveyor 50 for movement to a suitable processing point in the plant.

When the surface 64 of the cleaning element becomes dirty or sufficiently clogged with the contaminants removed from the tobacco leaves, it is a simple matter to replace the sheet 61 simply by pulling it off the roller to disengage the hook members on the surface 63 from the loop members 60 on the fastener portion which is bonded to the surface of the cleaning roller. A new sheet 61 then is pressed into place in the same manner described above and resumption of operation of the machine, with new cleaning elements 61, readily is effected.

In a typical machine, the rollers 11 through 18 have a length which is 29 inches and the diameter of the rollers of a working embodiment is 4 inches. The rollers themselves are mounted on a shaft having a diameter of approximately 1 and 1½ inches. The protuberances 20 in a commercial embodiment of the machine, using rollers having the dimensions described above, have a substantially square cross-section of 1 inch by 1 inch. The motor 40 in such a preferred embodiment rotates the rollers 11 through 18 at one-hundred thirteen (113) RPM.

The foregoing description of the preferred embodiment of the invention is to be considered illustrative and not as limiting. Various changes and modifications will occur to those skilled in the art without departing from the true scope of the invention. The particular dimensions, speed of rotation, and the like readily may be varied by those skilled in the art without departing from the invention, the scope of which is set forth in the appended claims.

I claim:

1. A tobacco leaf cleaning system for removing foreign particles such as lint and string from tobacco leaves including in combination:

a plurality of roller means mounted side-by-side for rotation beneath tobacco leaves to be cleaned;

means for rotating said roller means for transferring tobacco leaves from one roller means to the next roller means in succession; and cleaning means in the form of densely packed resilient hook members attached to the surface of each of said roller means for removing lint and foreign particles from leaves contacted by said cleaning means and for retaining such lint and foreign particles so removed on said cleaning means.

2. The combination according to claim 1 further including delivery means for supplying tobacco leaves to be cleaned to said plurality of roller means.

3. The combination according to claim 2 wherein said cleaning means is removably mounted on the surface of said roller means.

4. The combination according to claim 3 wherein said means for rotating said roller means rotates said roller means in the same direction.

5. The combination according to claim 4 wherein the surface of each of said roller means has securing means attached thereto in the form of the loop portion of a fabric hook-and-loop fastener material.

6. The combination according to claim 5 wherein said cleaning means further comprises a double-sided hook portion of fabric hook-and-loop fabric fastener material with one side thereof pressed against and secured by the loop fastener material of said securing means and the other side thereof facing outwardly and comprising said cleaning means.

7. The combination according to claim 6 wherein said cleaning means is made of the hook portion of said hook-and-loop fabric fastener material and said securing means is made of the loop portion of said hook-and-loop fabric fastener material.

8. The combination according to claim 7 wherein said plurality of roller means have protuberances on the surface thereof for agitating tobacco leaves passing thereover.

9. The combination according to claim 8 wherein said protuberances comprise elongated protuberances extending across said roller means on the surfaces thereof parallel to the axes thereof.

10. The combination according to claim 9 wherein said protuberances further comprise four elongated rectangular bars mounted at 90° spacings on the surface of each of said plurality of roller means parallel to the axis thereof.

11. The combination according to claim 10 wherein said plurality of roller means are rotated at substantially the same speed by said rotating means.

12. The combination according to claim 11 wherein said cleaning means is fabricated from a sheet of material having a plurality of densely packed resilient hook members on the surface thereof, said material folded over and secured together to cause said hook members to be on both sides thereof.

13. The combination according to claim 1 wherein said cleaning means comprises a removable and replaceable cleaning element.

14. The combination according to claim 13 wherein the surface of each of said roller means has securing means attached thereto in the form of the loop portion of a fabric hook-and-loop fastener material.

15. The combination according to claim 14 wherein said cleaning means further comprises a double-sided hook portion of fabric hook-and-loop fastener material with one side thereof pressed against and secured by the loop fastener material of said securing means and the other side thereof facing outwardly and comprising said cleaning means.

16. The combination according to claim 15 wherein each of said roller means has a plurality of protuberances thereon, with the protuberances of each successive roller means being offset with respect to the protuberances on the immediately preceeding and the immediately following roller means of said plurality of roller means.

17. The combination according to claim 1 wherein said cleaning means is removably mounted on the surface of said roller means.

18. The combination according to claim 1 wherein said means for rotating said roller means rotates said roller means in the same direction.

19. The combination according to claim 18 wherein each of said roller means has a plurality of protuberances thereon, with the protuberances of each successive roller means being offset with respect to the protuberances on the immediately preceeding and the immediately following roller means of said plurality of roller means.

20. The combination according to claim 1 wherein the surface of each of said roller means has securing means attached thereto in the form of the loop portion of a fabric hook-and-loop fastener material.

21. The combination according to claim 20 wherein said cleaning means comprises a double-sided hook portion of fabric hook-and-loop fabric fastener material with one side thereof pressed against and secured by the loop fastener material of said securing means and the other side thereof facing outwardly and comprising said cleaning means.

* * * * *